United States Patent [19]

Eicker et al.

[11] 4,395,608

[45] Jul. 26, 1983

[54] SAFETY SWITCH ASSEMBLIES

[75] Inventors: Karl-Georg Eicker, Remscheid; Siegfried Schulz, Hückeswagen; Burkhart Seim, Radevormwald, all of Fed. Rep. of Germany

[73] Assignee: K. A. Schmersal GmbH & Co., Wuppertal, Fed. Rep. of Germany

[21] Appl. No.: 339,175

[22] Filed: Jan. 13, 1982

[30] Foreign Application Priority Data

Jan. 14, 1981 [DE] Fed. Rep. of Germany ..... 3100862

[51] Int. Cl.[3] ..... H01H 21/84

[52] U.S. Cl. ..... 200/153 L; 200/61.62; 200/302

[58] Field of Search ..... 200/153 L, 334, 61.61, 200/61.62, 61.81, 61.82, 165, 302

[56] References Cited

U.S. PATENT DOCUMENTS

| | | | |
|---|---|---|---|
| 2,186,818 | 1/1940 | Brown | 200/61.82 |
| 2,196,865 | 4/1940 | Hutt | 200/61.82 |
| 2,629,791 | 2/1953 | Le Tourneau | 200/302 X |
| 3,239,625 | 3/1966 | Clason | 200/302 X |
| 4,282,414 | 8/1981 | Johnston et al. | 200/16 A X |
| 4,319,106 | 3/1982 | Armitage | 200/153 L X |

FOREIGN PATENT DOCUMENTS

| | | | |
|---|---|---|---|
| 234956 | 9/1964 | Austria | 200/153 L |

*Primary Examiner*—John W. Shepperd
*Assistant Examiner*—Renee Kidorf

[57] ABSTRACT

An electrical interlock comprising a switch operated by a rotatable cam member coupled to the movable switch contacts by a longitudinally movable slider. Rotation of the cam member, which is contained within the same housing as the switch contacts, is caused by engagement, in slots in the periphery of the cam member, of an actuator mounted for movement relative to the switch housing.

15 Claims, 5 Drawing Figures

(A-B)

SAFETY SWITCH ASSEMBLIES

BACKGROUND OF THE INVENTION (1) Field of the Invention

The present invention relates to the enhancement of safety in the work place and particularly to the disabling of equipment upon the opening of an access door. More specifically, this invention is directed to electrical interlocks and especially to improvements in safety switch assemblies. Accordingly, the general objects of the present invention are to provide novel and improved methods and apparatus of such character.

(2) Description of the Prior Art

The interruption of operation of, and particularly the discontinuance of the delivery of electrical power to, a piece of equipment when an access door or protective cover is opened is often necessary. For this purpose, electrical controls, known in the art as interlocks, are commonly provided. Such interlocks will typically include a normally open safety switch which will be closed when the door, gate or other protective cover is in the closed condition and the apparatus associated therewith in operation. The interlock should be automatically and positively opened when the access door or cover is opened.

One type of safety switch assembly known in the prior art comprises a contact bridge, with a pair of outwardly extending rods, mounted on the door and cooperating with a pair of resilient contact members located on the door frame. The bridge establishes a path for current and thus comprises a current carrying switch member. The switch will be positively opened if the door on which the contact bridge is mounted is opened. While this type of safety switch is effective and of uncomplicated construction, it's use is limited to clean and dry environments since the switch is neither dust nor moisture proof.

It is also known to provide safety switches which are mounted on the hinge pin of a protective door or cover. Such hinge pin mounted swithes, however, are comparatively expensive and have limited utility since they may be employed only on doors which have a hinging movement.

Key-operated safety switches are also known in the prior art. In safety switches of the key-operated type, the interlock feature is engaged and disengaged by means of a lock and a code key matched thereto. While such key-operated switches provide positive protection, and thus may be used under dangerous conditions, they have the obvious disadvantage that the key must be available. This often poses a substantial inconvenience and may prevent rapid opening of the protective cover to disable the apparatus in an emergency.

A further type of prior art safety switch, in which the closure of switch contacts located in a housing mounted on the door frame is effected by a hook-shaped member mounted on the door, may be seen from Austrian Patent Specification No. 234,956. In safety switches of the type shown in this Austrian patent the hook-shaped member, which pivots as the door closes, engages a switch cam which, in turn, effects closure of the switch contacts. The hook-shaped member is generally U-shaped in cross-section and the frame mounted switch housing is provided with a corresponding U-shaped opening. A major disadvantage of safety switches of this type is that they may be actuated only from one side, i.e., there is only a single position for the hook-shaped member in which the switch can be operated. This lack of flexibility in mounting is a serious disadvantage since it is frequently necessary or desirable, for example in situations where space is limited, for the door mounted portion of the switch actuating system to approach the switch housing from an angle which is different from the single position of actuation possible with the switch of the aforesaid Austrian patent.

SUMMARY OF THE INVENTION

The present invention overcomes the above-discussed and other deficiences and disadvantages of the prior art by providing a novel and improved safety switch assembly.

A switch assembly in accordance with a preferred embodiment of the invention comprises a housing in which is mounted at least a first stationary electrical switch contact. A slide member, also mounted in the housing, carries a movable switch contact. The actuator for the slide member, which causes the opening and closing of these stationary and movable switch contacts, comprises a rotary cam which is also located within the housing and operatively connected to the slide member. An external actuator enters the switch housing via one of a plurality of slots provided therefor and engages the periphery of the rotary cam member to cause angular displacement thereof. Angular displacement of the cam member will be translated into longitudinal movement of the slide member and thus into relative movement between the switch contacts to open and close the switch.

A switch assembly in accordance with a preferred embodiment of the invention is further characterized by a housing divided into three serially arranged chambers. The switch contacts are located in a first of these chambers which is hermetically isolated from the ambient environment. The second or intermediate chamber comprises a sealing chamber wherein a seal is effected between the switch housing and the slide member which carries the movable switch contact. The third chamber, which is disposed at the opposite side of the sealing chamber with respect to the contact chamber, contains the rotary cam and the cam follower by which the slide member is operatively connected to the cam. The wall of the third or cam chamber is provided with the opening or openings through which the actuating member, which causes cam rotation, may enter the housing in order to effect angular displacement of the cam.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
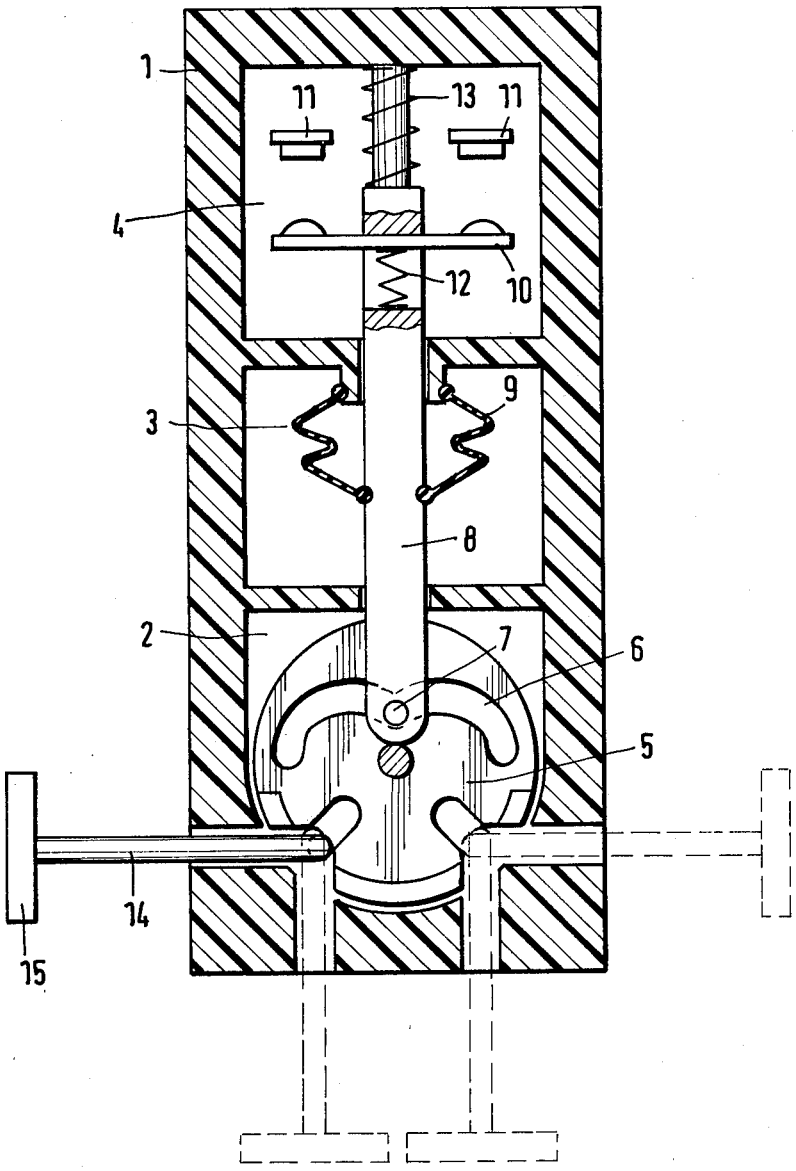
FIG. 1 is cross-sectional side elevation view of a safety switch in accordance with a preferred embodiment of the invention, the switch being depicted in the normally open condition in FIG. 1.
Figure 2:
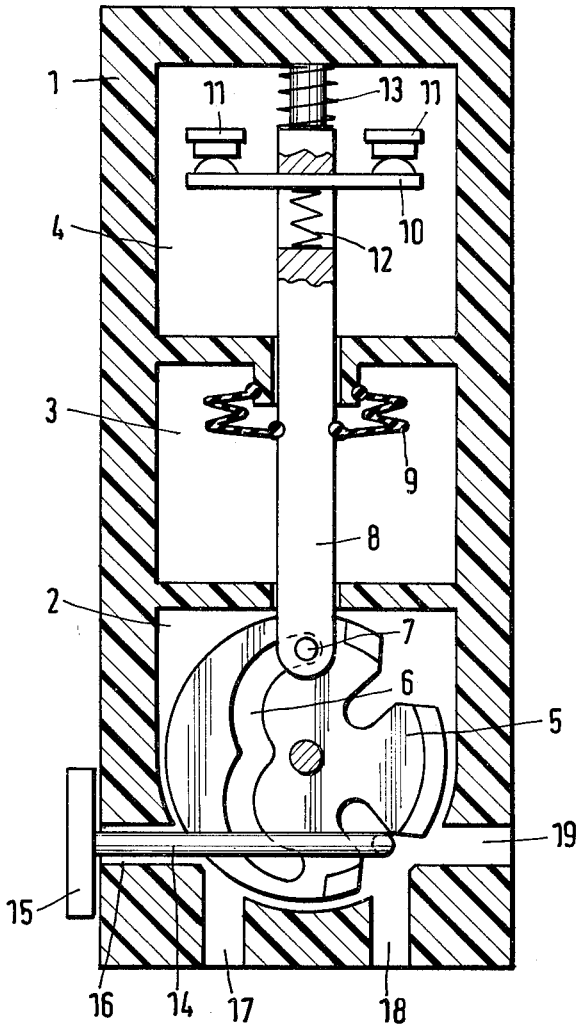
FIG. 2 is a view similar to FIG. 1 depicting the switch in the closed condition.
Figure 3:
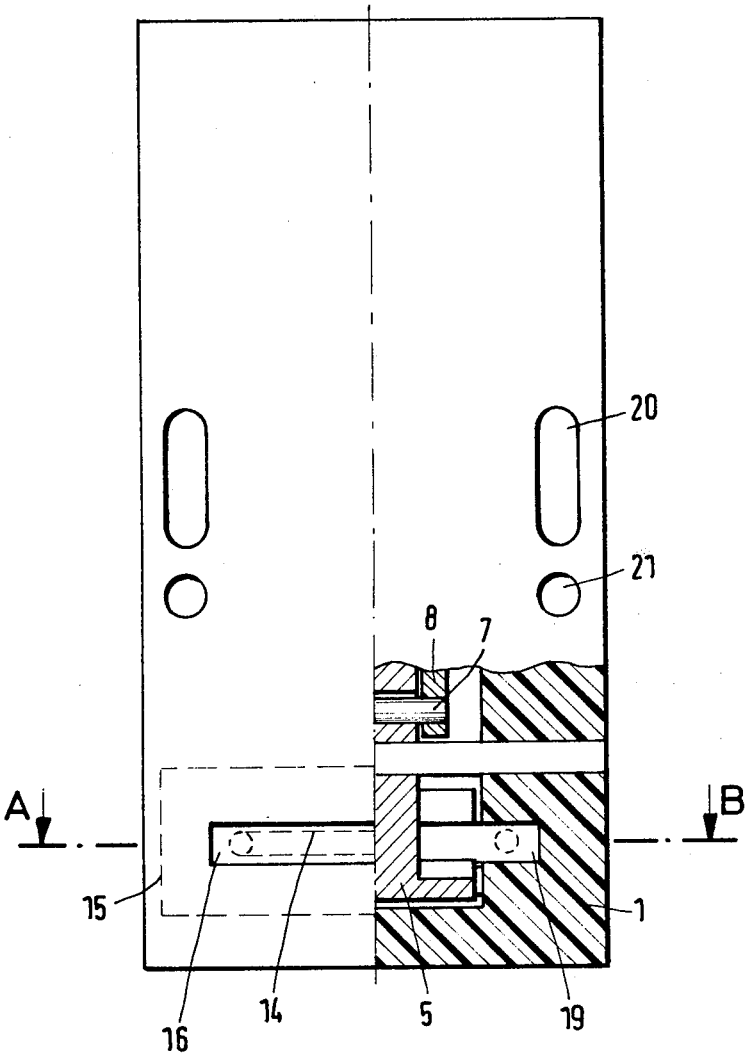
FIG. 3 is a front elevational view, partly in section, of the switch of FIGS. 1 and 2 rotated by 90 degrees from the showing of FIGS. 1 and 2.
Figure 4:
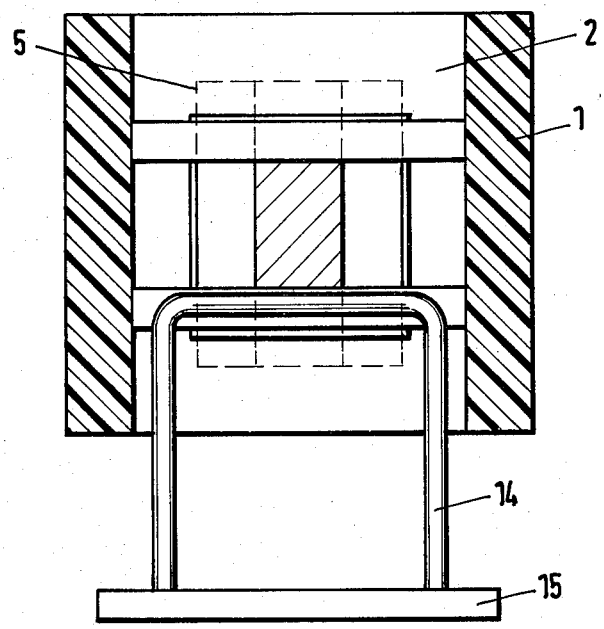
FIG. 4 is a cross-sectional view taken along line A-B of FIG. 3.

With reference simultaneously to FIGS. 1–4, a safety switch in accordance with the present invention comprises a housing 1 fabricated from a suitable non-conductive material. Housing 1 defines serially arranged internal chambers 2, 3 and 4. A switch actuator is partly located within chamber 2 and comprises a cam member 5 mounted for rotation about an axis. The cam 5 is provided with a cam track or slot 6 which is engaged by a pin 7 affixed to the first end of a slide member 8. The slide member 8 extends, from the cam chamber 2, through the intermediate sealing chamber 3 and into the contact chamber 4 of housing 1.

In order to hermetically seal the contact chamber 4 from the ambient environment, a flexibly bellows 9 is provided within the sealing chamber 3. The bellows is sealed to the slide member 8 and to the housing partition which defines the dividing wall between chambers 3 and 4.

In the embodiment disclosed in the drawing the safety switch comprises a pair of stationary contacts 11 which are supported, by means not shown, in chamber 4. The stationary contacts 11 will, of course, be connected to conductors, not shown, which extend through the wall of the housing and are sealed thereto. An electrical circuit 8 is made and broken by means of establishing a path of current flow between the stationary contacts 11. This is accomplished by the movable contact member 10 which is mounted on the slide member 8. In the embodiment shown the movable contact 10 comprises a pair of contact buttons, which cooperate with respective of the stationary contacts 11, and an interconnecting bar of conductive material which passes through an opening in the slide chamber 8. The movable contact 10 is resiliently biased, by means of a spring 12, toward the stationary contacts 11 to insure that, when the switch is in the closed position, electrical contact will be established between the movable and stationary contacts. The possible movement of contact 10 along slide member 8 will be less than the total movement of the slide member itself in response to rotation of cam 5. The switch being described is a normally open switch and thus the slide member 8 is biased, by means of a spring 13, so as to urge the movable contact 10 away from the stationary contacts 11. The limit of movement in the opening direction is defined by the cam slot 6 in rotary cam 5.

In the typical case, the housing 1 will be mounted on a stationary member, for example a door frame, and will cooperate with a movable actuator mounted on a door. The movable actuator will comprise a U-shaped stirrup 14 formed from a wire of circular or oval cross-section. The stirrup 14 will be affixed to and extend from the mounting plate 15 and may best be seen from FIG. 4. The stirrup 14 will enter the cam chamber 2 of housing 1 via one of a plurality of openings 16, 17, 18 and 19 (FIG. 2) and will engage a notch or recess provided in the periphery of the cam 5.

As previously noted, the switch is shown in FIG. 1 in its normally open condition. This, of course, would be the safe position where the door on which the plate 15 and stirrup 14 are mounted is open. Accordingly, under the action of biasing spring 13, the slider 8 will be urged to the bottom of the cam slot 6 in rotary cam 5 and thus be movable switch contact 10 will be spaced from the stationary contacts 11.

Upon closing of the door on which the plate 15 is mounted, the stirrup 14 will enter the appropriate opening in housing 1 and will engage a peripheral recess on cam 5. As may be seen by the comparison of FIGS. 1 and 2, the closing of the door will thus cause the rotation of cam 5 which, through the cooperation of the pin 7 with cam slot 6, will cause the slide member 8 to move longitudinally in a direction transverse to the axis of rotation of cam 5. This motion of slide member 8 will overcome the bias of spring 13 and cause the closing of the switch contacts.

Safety regulations will often require that a switch employed as an electrical interlock have its contacts mechanically and reliably held in the open state by the switch actuator. It is further often required that the switch remain operative should the biasing spring fail. A switch in accordance with the present invention meets these requirement because, upon opening of the door to which the plate 15 is affixed, the stirrup 14 will rotate the cam 5 back to the open position shown in FIG. 1. Thus, as stirrup 14 is withdrawn from housing 1, the pin 7 will be caused to slide back along the cam slot 6 from the position of FIG. 2 to that of FIG. 1. This positive connection of the rotary cam 5 to the movable switch contact 10 via the slide member 8 will result in the switch contacts being opened if spring 13 should break and will further cause the opening of the switch contacts even if they are lightly welded together by arc-over during closing.

Figure 5:
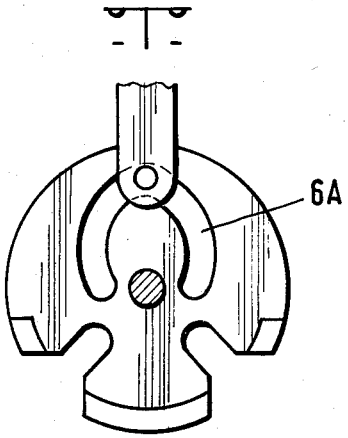
FIG. 5 is a plan view of an alternative cam arrangement for use in the switch of FIGS. 1–4.

The switch described above is suitable for use when a "slow" action, in which the opening and closing of the switch contacts is effected slowly, may be tolerated. Thus, in the embodiment described, the opening or closure of the switch contacts is dependent upon the actuation speed. The switch may, however, be converted into a "jump" action device, i.e., a switch in which the relative movement between the contacts is independent of the actuation speed, by replacing the cam 5 shown in FIGS. 1 and 2 with the cam depicted in FIG. 5. In the FIG. 5 embodiment the cam has a slot or cam track 6A formed so that in the open configuration the slide member 8 is urged to its point of maximum extension into the contact chamber 4. In the actuated position the pin 7 will "fall off" the highest point of the cam substantially immediately upon the beginning of rotation thereof and the slide member 8 will move, under the influence of biasing spring 13, to its point of minimum extension into the contact chamber 4. This mode of operation will, of course, require the reversal of the position of the movable and stationary switch contacts as indicated schematically in FIG. 5.

A further important feature of the present invention resides in the fact that it is exceedingly difficult to "defeat" the safety switch. Thus, it is not possible to cause closing of the switch contacts, with the door on which the plate 15 is mounted being in the opened condition, merely by insertion of a tool, such as a screwdriver, into one of the stirrup receiving openings in the housing. The small width of the openings precludes the use of such a flat plated tool to impart sufficient rotation to cam 5 to cause the switch contacts to be closed. Thus, the service technician must be provided with a special tool, having in part the configuration of stirrup 14, in order to close the switch contacts when the cover or door is open.

It will be appreciated that frequently during the movement of a door in a door frame large tolerances can be present or can arise in time. Thus, for example, slight misalignment between the stirrup 14 and openings in housing 1 may occur as a result of settling of the door on which plate 15 is mounted. However, in order for proper operation of the switch a relatively precise relationship must be maintained between the location of the stirrup 14 and the cooperating one of openings 16, 17, 18 and 19 in housing 1. In order to insure that the proper alignment will be maintained, as may be seen from FIG. 3, locating holes 21 are provided in housing 1 in the region of the mounting slots 20. Guide members, for example of conical form, may be mounted on plate 15 to one side of the stirrup 14 such that, upon initial closure of the door, these guide members will enter the locating holes 21 and thus effect the desired relative alignment between the switch housing and the stirrup.

One of the numerous advantages of the present invention resides in the flexibility of use inherent therein. Thus, by virtue of the possibility of actuating the switch from various sides, the user is provided with a high degree of freedom and, in many cases, the necessity of making some modifications to the equipment to be protected for the purpose of mounting a safety switch is eliminated.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A safety switch assembly comprising:

a housing;

a stationary electrical contact mounted within said housing;

an elongated slide member mounted for movement within said housing;

a moveable electrical contact supported on said slide member adjacent a first end thereof;

cam follower means affixed to said slide member adjacent the second end thereof;

cam means supported for rotation in said housing, said cam means including a rotatable member having a cam track therein; and means coupling said cam means rotatable member to said cam follower means whereby said cam track is engaged by said follower means, said cam track being symmetrical with respect to said cam follower means when said cam means rotatable member is in a datum position, angular displacement of said cam means in either a clockwise or counterclockwise direction from the datum position causing displacement of said slide means to thereby effect relative movement between said electrical contacts to alter the electrical condition of the switch assembly.

2. The apparatus of claim 1 wherein said cam track is contoured such that rotation of said cam member from its datum position will cause said cam follower to move outwardly with respect to the rotational axis of the cam means rotatable member along an arcuate path.

3. The apparatus of claim 1 or 2 wherein said housing is generally of rectangular cross section and is provided with openings in three adjacent faces, and wherein said switch assembly further comprises:

actuator means, said actuator means being extendable into said housing through any of said openings, said actuator means engaging said cam means and imparting rotation thereto.

4. The apparatus of claim 3 wherein said movable electrical contact is movable relative to said slide member in the direction of movement of said slide member, said relative movement being constrained to be less than the movement imparted to said slide member by said cam means.

5. The apparatus of any one of claims 1 or 2 wherein said movable electrical contact is movable relative to said slide member in the direction of movement of said slide member, said relative movement being constrained to be less than the movement imparted to said slide member by said cam means.

6. The apparatus of claim 1 or 2 further comprising:

actuator means for said switch, said actuator means including a generally U-shaped member, said housing being provided with an opening through which said U-shaped member may be inserted and said cam means being provided with a surface irregularity for engagement by said U-shaped member whereby said actuator means may be caused to engage said cam means to effect angular displacement thereof to operate said switch from a first condition to a second condition.

7. The apparatus of claim 6 wherein said housing is generally of rectangular cross section and is provided with actuator means U-shaped member receiving openings in three adjacent faces.

8. The apparatus of claim 7 wherein said movable electrical contact is movable relative to said slide member in the direction of movement of said slide member, said relative movement being constrained to be less than the movement imparted to said slide member by said cam means.

9. An electrical switch comprising:

housing means, said housing means defining three serially arranged chambers;

a slide member movably supported in said housing means and extending into all three chambers;

at least a first stationary electrical contact positioned in a first of said housing means chambers;

a movable electrical contact mounted on said slide member and located in said first chamber for cooperation with said stationary contact;

means located in the intermediate of said chambers for establishing a flexible seal between said slide member and said housing means whereby said first chamber is rendered hermetic;

cam means supported for rotation in the third of said housing means chambers;

a cam follower affixed to said slide member and cooperating with said cam means whereby rotation of said cam means will impart longitudinal movement to said slide member to establish relative motion between said stationary and movable contacts whereby said switch may be selectively opened and closed; and actuator means, said actuator means in part extending into said housing means third chamber and imparting rotation to said cam means.

10. The apparatus of claim 9 wherein said cam means comprises:

a cam member rotatable about an axis, said cam member having a cam track formed therein for receiving said cam follower, said cam member further being provided in its periphery with at least a first slot which extends radially inwardly toward the axis of rotation of the cam member; and wherein said actuator means includes:

an elongated member which extends through an opening in said housing means into said third chamber, said elongated portion lying in a plane parallel to an end face of the cam member; and a cam engaging portion which is generally transverse to said elongated portion, said cam engaging portion engaging said cam member peripheral slot.

11. The apparatus of either one of claims 9 or 10 further comprising:

means for resiliently biasing said slide member in a first direction.

12. Apparatus of claim 11 wherein said movable contact is movably supported on said slide member and wherein said apparatus further comprises:

means for resiliently biasing said movable contact in a second direction opposite to said first direction.

13. The apparatus of claim 11 wherein said cam track is contoured such that rotation of said cam member from a datum position will cause said cam follower to move outwardly with respect to the rotational axis of the cam member along an arcuate path.

14. The apparatus of claim 13 wherein said housing is generally of rectangular cross section and is provided with openings in three adjacent face for receiving said actuator means.

15. The apparatus of claim 14 wherein said actuator means comprises:

a generally U-shaped member.

* * * * *